United States Patent [19]

Herrington, Jr.

[11] Patent Number: 4,513,559

[45] Date of Patent: Apr. 30, 1985

[54] BAG TRANSPORTER, FOLDER AND LOADER AND METHOD FOR OPERATION

[75] Inventor: Fox J. Herrington, Jr., Holcomb, N.Y.

[73] Assignee: Mobil Oil Corporation, New York, N.Y.

[21] Appl. No.: 488,243

[22] Filed: Apr. 25, 1983

Related U.S. Application Data

[63] Continuation-in-part of Ser. No. 329,371, Dec. 10, 1981.

[51] Int. Cl.[3] ..... B65B 63/04

[52] U.S. Cl. ..... 53/429; 53/117; 493/409; 493/457

[58] Field of Search ..... 53/429, 447, 117; 493/438, 447, 448, 179, 456, 457, 458, 937, 177, 493/409

[56] References Cited

U.S. PATENT DOCUMENTS

| | | | |
|---|---|---|---|
| 1,708,534 | 4/1929 | Christman | 493/457 |
| 1,909,050 | 5/1933 | Ferguson | 53/429 |
| 2,785,609 | 3/1957 | Billeb | 493/438 |
| 3,919,827 | 11/1975 | Larson | 53/429 |
| 4,008,887 | 2/1977 | Karolyi | 493/457 |
| 4,037,386 | 7/1977 | Sjoman | 53/429 |
| 4,218,962 | 8/1980 | Cunningham | 53/117 |

FOREIGN PATENT DOCUMENTS

| | | | |
|---|---|---|---|
| 2356877 | 5/1975 | Fed. Rep. of Germany | 53/117 |
| 2742260 | 4/1978 | Fed. Rep. of Germany | 53/117 |

*Primary Examiner*—Leonidas Vlachos
*Attorney, Agent, or Firm*—Alexander J. McKillop; Michael G. Gilman; Charles J. Speciale

[57] ABSTRACT

A reciprocative apparatus individually folds a plurality of thin, limp, sheet-type articles, such as sandwich bags, and loads them into a carton. The apparatus includes a delivery assembly for sequentially transferring the bags from a conveyor belt to a folding station. A pivotally operated swatter is employed in the delivery assembly which includes a swatter driving mechanism which gradually decelerates the swatter near the end of its forward movement to minimize article wrinkling.

34 Claims, 18 Drawing Figures

BAG TRANSPORTER, FOLDER AND LOADER AND METHOD FOR OPERATION

CROSS-REFERENCE TO RELATED APPLICATIONS

This application is a continuation-in-part of U.S. application Ser. No. 329,371, filed Dec. 10, 1981. To the extent any of the disclosure of Ser. No. 329,371 is not repeated hereinbelow, it is incorporated herein by reference.

BACKGROUND OF THE INVENTION

This invention relates to folding and loading of thin, limp, sheet-type articles into a receptacle therefor and particularly relates to folding and loading of small plastic bags, such as sandwich bags, into a dispensing box or carton. It also, more particularly, relates to an improved transporting mechanism for transporting a sheet-type article from a conveyor to a folding station and to the combination of the transporting mechanism with the conveyor and folding station.

Plastic sheet materials present many handling and dispensing problems which are magnified when the sheet is thin, limp, and subject to loading by static electricity. Exemplary plastic sheet materials which are used in large quantities at the present time are plastic bags, such as trash bags, product bags and sandwich bags. Many of these bag products are assembled, shipped and dispensed in roll form. Others, however, are preferably handled in folded form because of consumer preferences, economy in storage, and/or ease of handling and dispensing. Folding of such bags can be performed by in-line machinery without great difficulty when the bags are large, as, for example, bulk bags and trash bags.

However, when the bags are quite small, such as sandwich bags, for example, so many difficulties occur with presently available machinery that the present practice is to use manual labor for folding and loading plastic sandwich bags into dispensing boxes therefor. There is consequently a need for new concepts and arrangements that will overcome the specific problems peculiar to folding and loading of such thin plastic articles of relatively small size. These difficulties arise because the bags must be sequentially picked up from a conveyor, folded, folded again, transported to a receptacle, loaded into the receptacle and pressed against its bottom in order to remove entrapped air. In each of these operations, the lightness, limpness, thinness and smallness of the bags present special handling problems, particularly when static electricity is present. Simply scaling down conventional folding machines does not solve these problems because the prior art devices inherently rely upon significantly greater stiffness, bulk, basis weight and like properties.

A method for sequentially packaging flexible plastic refuse bags is taught in U.S. Pat. No. 3,842,568, which comprises reeling a bag into a mandrel, pulling it sidewise in reeled condition from the mandrel and tamping the reeled bag into a carton.

An apparatus is described in U.S. Pat. No. 3,918,699 for multiple folding of soft articles, such as textile and paper articles. It includes a plurality of cooperating longitudinal and transverse folding arms which are operable according to a predetermined sequence and which cooperate with folding plates. More specifically, the middle portion of an article to be folded is brought under a folding plate, while its side portions lie on the longitudinal side folding arms of the machine. The side folding arms then operate toward each other in sequence so they form two folds and longitudinally overlap the two side portions. This prefolded article is next delivered to a second folding station where transversely disposed folding arms sequentially perform similar single foldings. The longitudinally and transversely folded article is finally delivered to a stacking station.

An apparatus and method for folding textile materials is taught in U.S. Pat. No. 4,008,887. It comprises a plurality of pivotal folding flap plates for sequentially folding the material, while gripping devices at the movable plates prevent unfolding and/or shifting of the material. The gripping members are C-shaped fingerlike elastic elements mounted on rotatable gripper shafts which are connected to rotatable flexible shafts and to a control mechanism for sequentially controlling the rotation of the shafts.

SUMMARY OF THE INVENTION

It is accordingly an object of this invention to provide a method and an apparatus for picking up a plurality of thin, limp, sheet-type articles from a conveyor, folding the articles and sequentially loading the folded articles into a receptacle therefor.

It is also an object to provide a transporting means for partially folding each sheet article while delivering it from the conveyor to a folding station.

It is further an object to provide a transporting means for delivering, by means of a swatter, a sheet article from a conveyor to a folding station without abrupt stopping and overtravel of the swatter to thereby minimize wrinkling of the sheet article, while still retaining a high average article transporting velocity.

It is further an object to provide a transporting means of the type described in the preceding paragraph in combination with a sheet-type article conveyor and folding station.

According to these objectives and the principles of this invention, an apparatus is herein provided for sequentially delivering, folding and loading a plurality of thin, limp, sheet-type articles into a receptacle or carton, after these articles have been sequentially conveyed to a pick-up station, and for packing the loaded articles within the carton.

BRIEF DESCRIPTION OF THE DRAWINGS

The invention may be more clearly understood by referring to the following drawings, which show an apparatus which is suitable for carrying out the method of this invention.

DESCRIPTION OF THE EMBODIMENTS

The apparatus of this invention comprises sheet-delivering, sheet-folding and folded-sheet loading assemblies, as shown in FIGS. 1–17, which sequentially remove a thin, limp article in sheet form from a conveyor, fold it into thirds and pack the folded article within a receptacle, such as a box or carton. The sheet-folding and folded-sheet loading assemblies are described herein as a folder-loader assembly. FIGS. 12–17 illustratively show a sandwich bag as a suitable thin, limp, sheet-type article, but the apparatus is effective with sheet-type articles of any size if they are limp enough to be readily folded.

Figure 9:
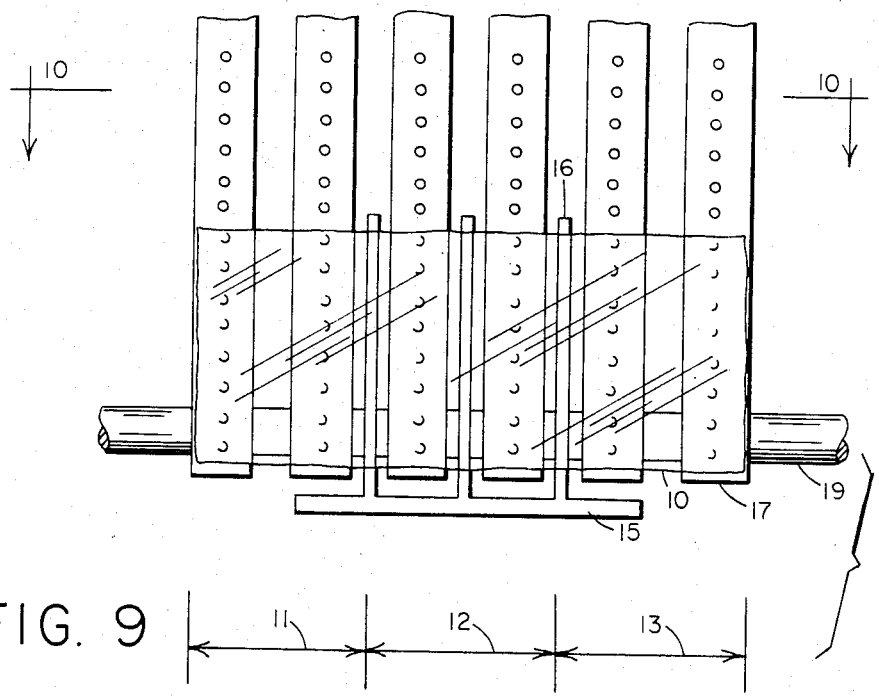
FIG. 9 is a plan view of the pick-up station at the end of a bag conveyor, with one bag positioned on the stopped conveyor and centered over the swatter prongs.
Figure 10:
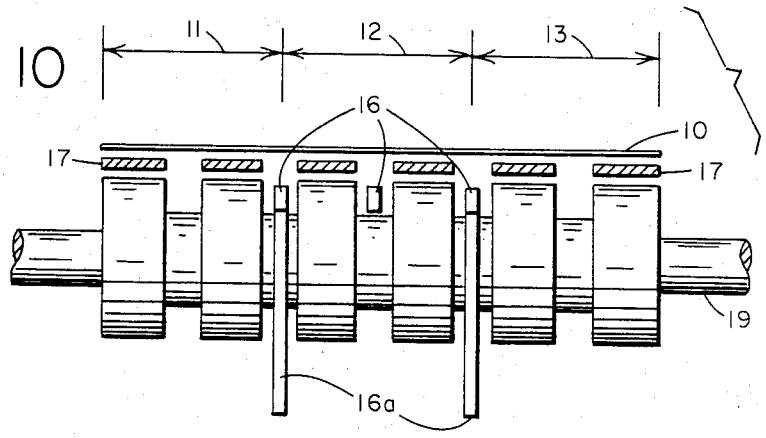
FIG. 10 is a sectional side elevation, looking in the direction of the arrows 10—10 in FIG. 9, which shows the conveyor shaft, conveyor belts, swatter prongs, swatter tines and the bag lying on the belts.

The sheet delivering assembly comprises a pivotable swatter having prongs 16 which nest at a pick-up station between conveyor belts 17 before a bag 10 reaches the pick-up station, as seen in FIGS. 9 and 10. Conveyor belts 17 stop as soon as a bag 10 arrives at the pick-up station, and shaft 15 thereupon rotates through an arc of 180°, if conveyor belts 17 are horizontally disposed, or through an arc of 90°, if conveyor belts 17 are vertically disposed, although other arcs are feasible, such as 135°. In the latter situation, it is generally desirable and sometimes necessary (depending on the size, weight and limpness of the article) that vacuum orifices (not shown in the drawings) be disposed at the pick-up station, as is known in the art, in order to exert a slight holding force upon each bag 10 and maintain it in parallel to belts 17 before prongs 16 exert a separating force thereupon.

Figure 5:
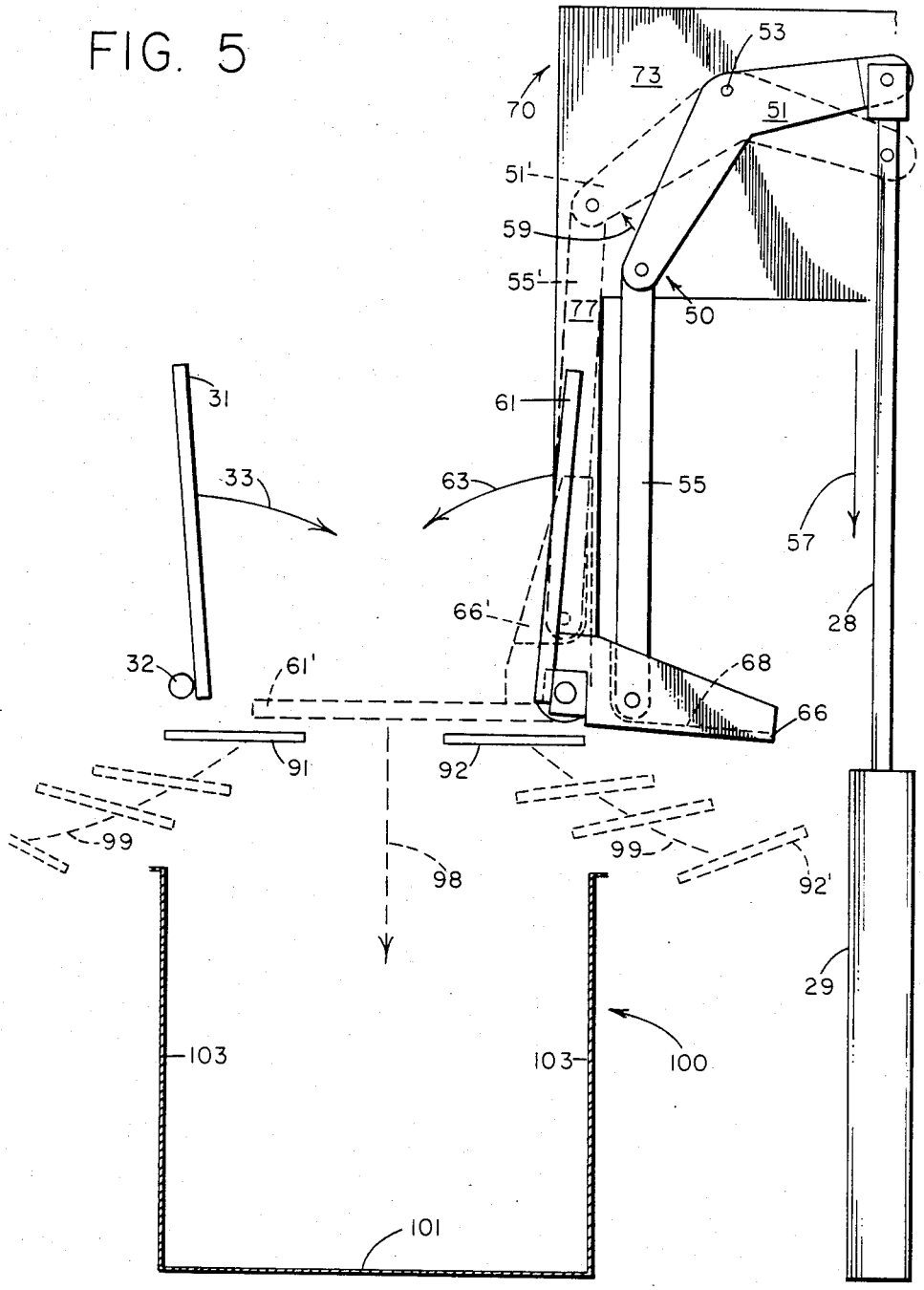
FIG. 5 is a partial sectional view, in elevation and similar to FIG. 4, showing left and right flippers, left and right trays and a rocker arm assembly for pivoting the right flipper, and further showing the pivoted right flipper, right flipper arm and rocker arm in phantom view, with both trays also being in phantom view as they move beyond the carton therebeneath.
Figure 6:
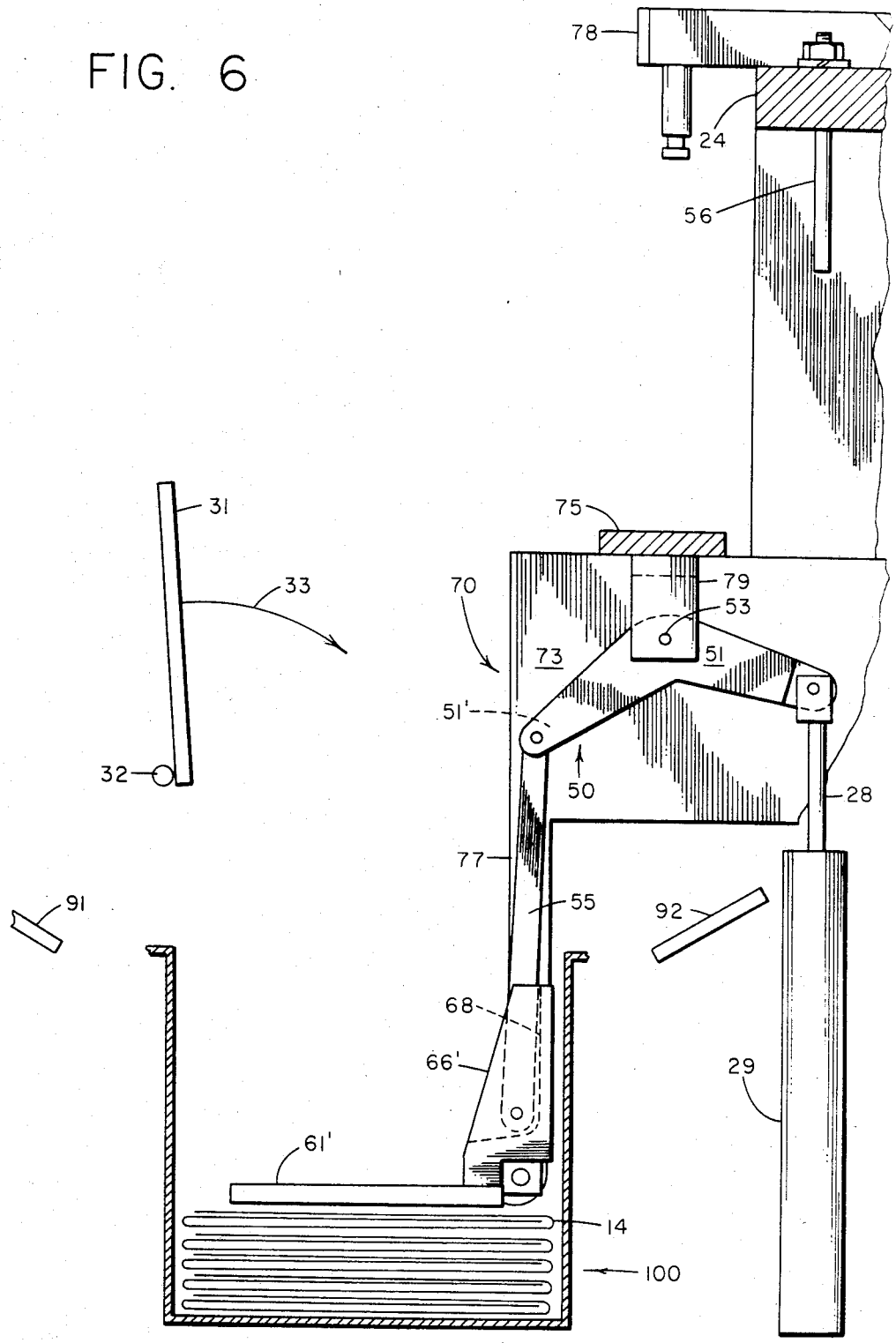
FIG. 6 is a partial sectional view, in elevation and similar to FIG. 5, showing the right flipper performing the packing operation after having loaded a folded bag into the carton and on top of several previously loaded and packed bags.
Figure 12:
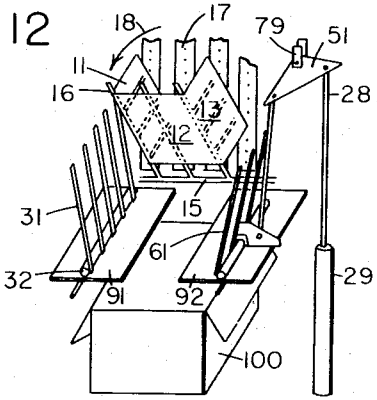
FIG. 12 is a partial perspective view of a carton being used as a receptacle, of a folding station above the carton which includes the left and right trays and the upright left and right flippers above the trays, and of a swatter which is pivotally delivering a partially folded sandwich bag, with its end portions trailing behind its middle portion which is supported by the swatter at the fold lines, from the conveyor and onto the trays between the flippers.

Alternatively, a cylinder and cylinder rod having a pick-up device may be used as the delivery assembly, or an upside-down conveyor may be employed to deposit the picked-up article in the folding station seen most clearly in FIGS. 5 and 12.

The swatter lays between conveyor belts 17 of an article-delivering conveyor so that prongs 16 and support tines **16*a* are pivotally beyond each sheet-type article that arrives on conveyor belts 17 and are athwart the article. Moreover, when conveyor belts 17 stop, each article is initially divided into thirds by outer prongs 16, so that center portion 12 of the article is between the outermost prongs 16 and the first and second end portions 11,13 thereof are endwise beyond these prongs. The swatter is actuated by a swatter driving cylinder so that shaft 15 rotates through an angle of 90°–180° to deliver the article to a folding station to be described hereinafter. After such delivery, the swatter pivots in the other direction to its waiting position beyond the surfaces of belts 17**.

Figure 13:
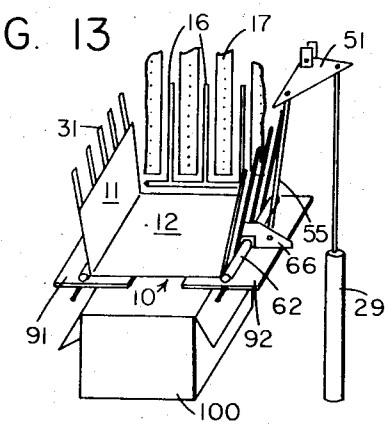
FIG. 13 is a perspective view, similar to FIG. 12, of the sandwich bag resting on the trays and between the flippers in partially folded position.

As visible in FIG. 12, prongs 16 cause bag 10 to be partially folded while it is revolving, because end portions 11, 13 of bag 10 trail behind middle portion 12 at an angle of approximately 90° and at least momentarily remain at this angle after arriving at the folding station, as a U-shaped channel which is formed by trays 91,92 and flipper tines 31,61. These end portions 11,13 remain, at least momentarily, upright against slightly diverging tines 31,61, while prongs 16 are pivoting in reverse toward the pick-up station, as seen in FIG. 13 after the reverse movement has been completed.

If it is necessary, however, depending upon the limpness of the material of bag 10, tines 31,61 and shafts 32,62 can be provided with passages therein which can be connected to a suction/pressure device for selectively producing a vacuum for holding portions 11,13 against tines 31,61 and then for producing positive pressure to separate end portions 11,13 from tines 31,61 after folding has been completed. Alternatively, vacuum devices can be disposed between tines 31,61.

The folder-loader assembly of this invention, as seen primarily in FIGS. 1–7, comprises a base 26, a pair of left vertical supports 21 which are rigidly attached to base 26, a left horizontal support 23 which is rigidly attached to top ends of supports 21, a pair of right vertical supports 22 which are rigidly attached to base 26 and a right horizontal support 24 which is rigidly attached to the top ends of supports 22. In combination, base 26, vertical supports 21,22 and horizontal supports 23,24 form a rigid frame which supports the folding, loading and packing means of the folder-loader assembly of the invention.

Figure 2:
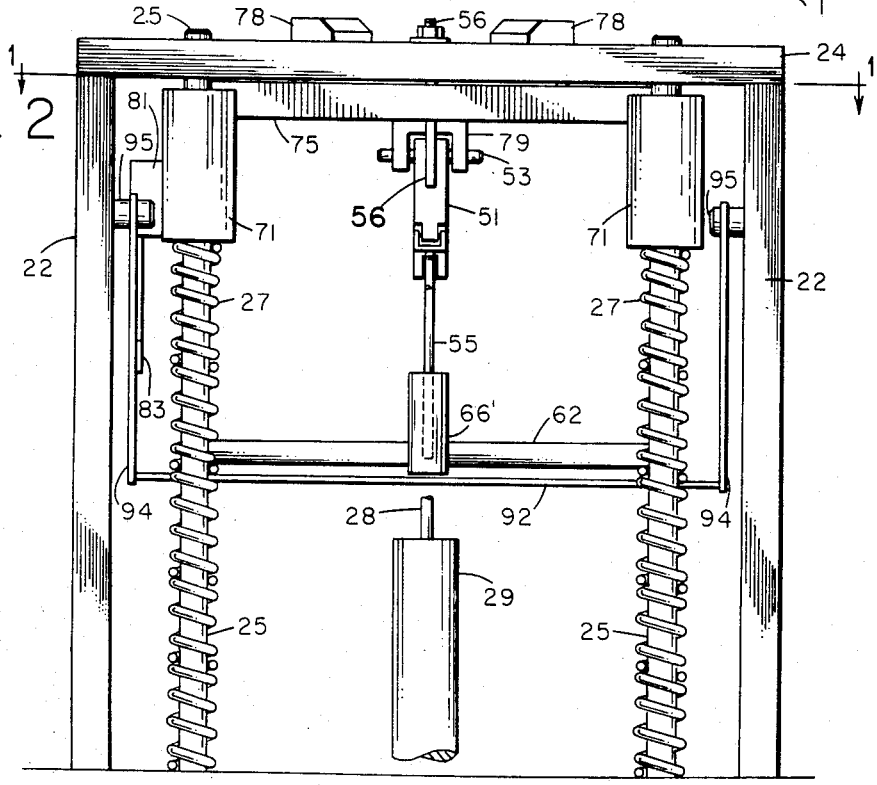
FIG. 2 is a side elevation view of a folder-loader assembly, looking in the direction of the arrows 2—2 in FIG. 1.
Figure 4:
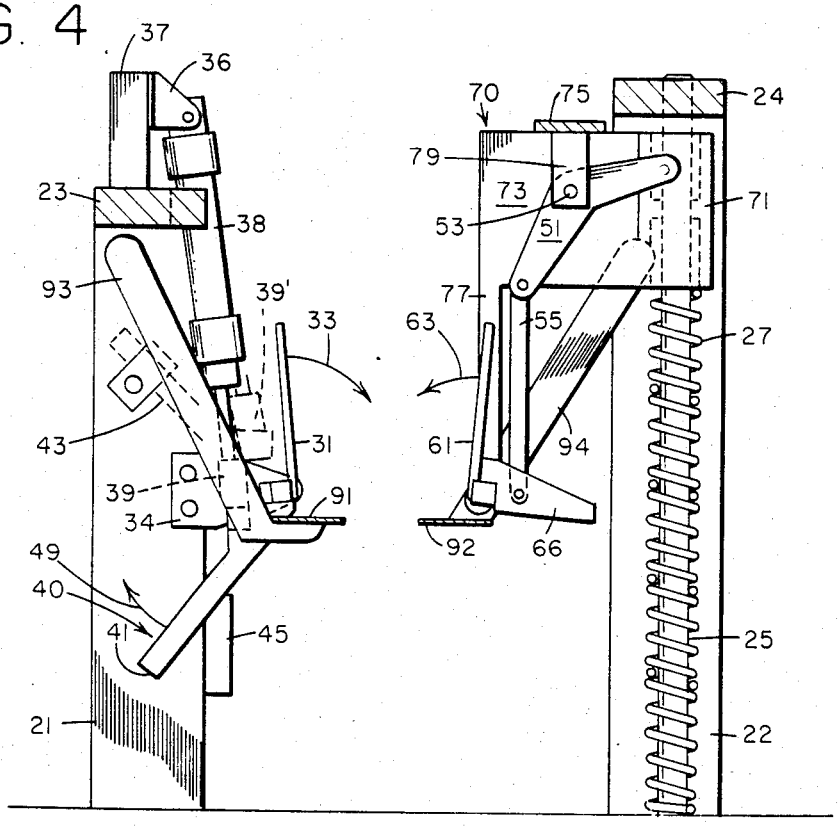
FIG. 4 is a sectional elevation view of the folder-loader assembly, looking in the direction of the arrows 4—4 in FIG. 1, but with the right flipper in standby position.
Figure 7:
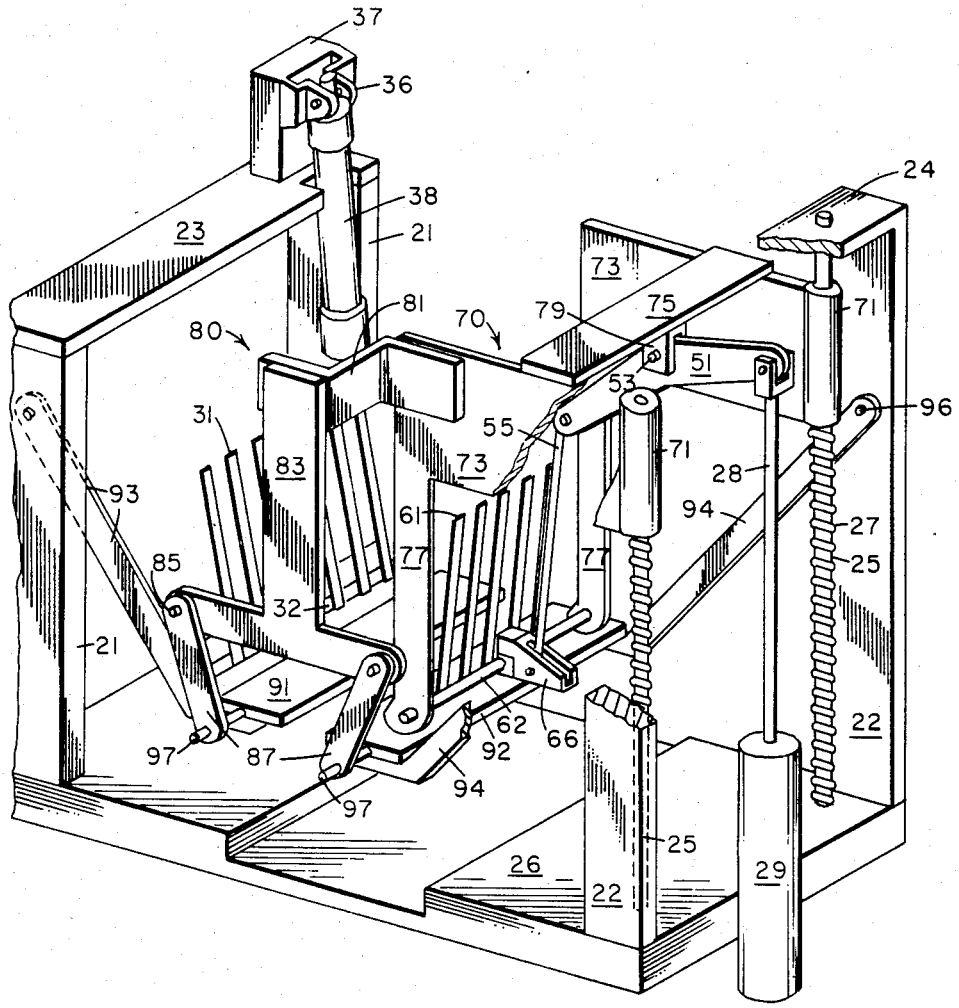
FIG. 7 is an isometric view of the folder-loader assembly from the right-front corner, with parts broken away.
Figure 8:
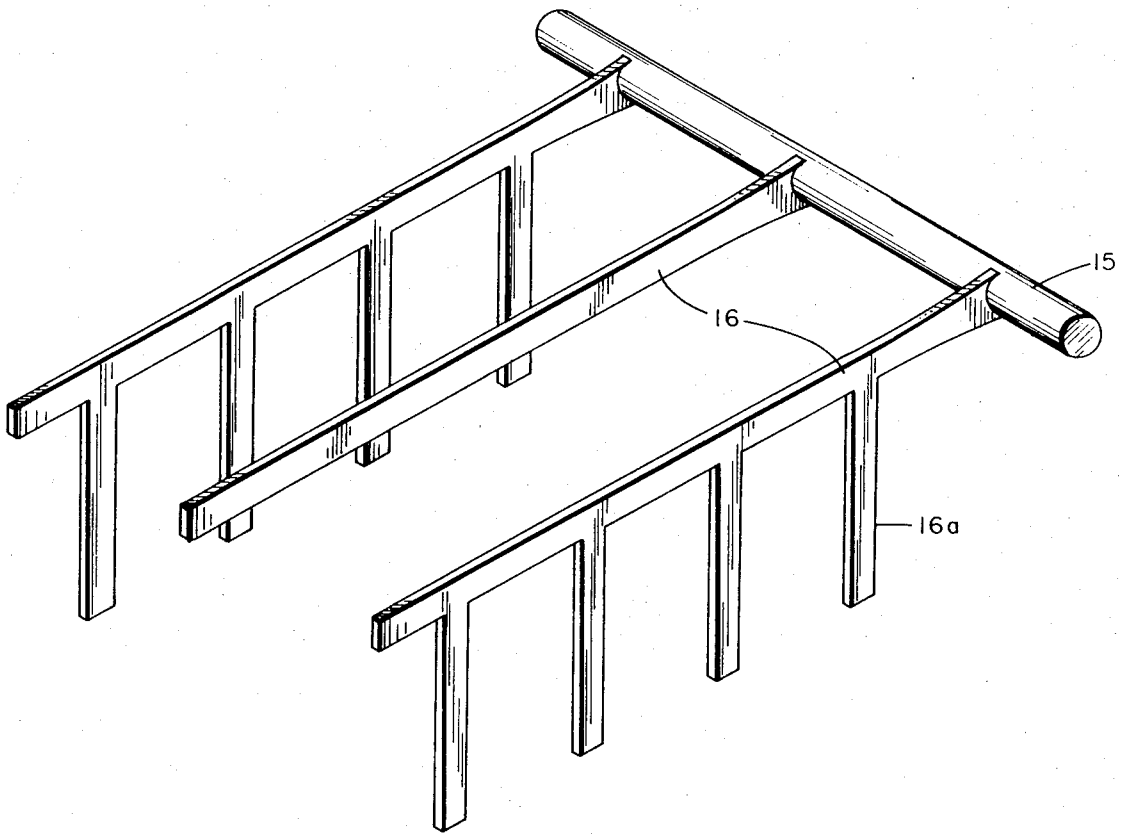
FIG. 8 is an isometric view of a swatter.

Guide rods 25 are also attached to base 26 and to right horizontal support 24, as partially indicated in FIG. 7. Coil springs 27, as seen in FIGS. 2, 4 and 7, encircle guide rods 25 and perform important biasing functions which separate secondary folding, loading and packing operations, as is described hereinafter. A loading cylinder 29, having a cylinder rod 28, is also attached to base 26 between supports 22.

A left flipper assembly 30, for performing the first folding operation on the left end portion 11 of bag 10, comprises a left flipper having tines 31 and shaft 32, a mounting bracket 34, to which shaft 32 is rotatably attached and a left flipper cylinder 38 which is attached to left horizontal support 23 with a mounting block 37 and mounting block bracket 36. The rod for cylinder 38 has at its lower end a clevis 39 which is attached to left flipper arm 41.

An assembly 40 comprises left flipper arm 41, an upper stop 43 for arm 41 and a lower stop 45 for arm 41. Stops 43 and 45 are rigidly attached to rear left support 21, as seen in FIG. 4, although they are omitted in FIG. 1. Tines 31 revolve in direction 33 to perform their folding movement, while arm 41 revolves in direction 49 from stop 45 to stop 43.

Figure 14:
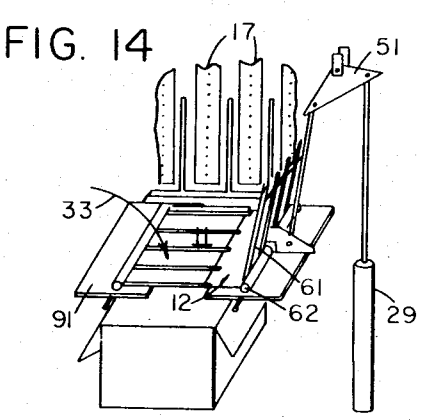
FIG. 14 is a perspective view, similar to FIGS. 12 and 13, which shows the left end portion being folded onto the middle portion by the left flipper.
Figure 17:
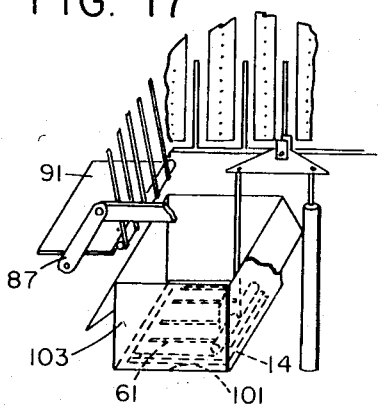
FIG. 17 is a perspective view, similar to FIGS. 12–16, which shows the right flipper pushing the folded bag against the bottom of the box; and, FIG. 18 illustrates in side view an improved linkage mechanism for moving the swatter.

Left flipper assembly 30 is promptly actuated by cylinder 38 after the swatter has pivotally departed. Its tines 31 pivot in direction 33 and fold end portion 11 onto middle portion 12, as seen in FIG. 14, and then immediately return to an upright position.

The second folding operation, the loading operation and the packing operation are performed by a double-function means utilizing a singly and linearly applied force in order to perform a pivoting movement and then a linear movement, wherein the pivoting movement accomplishes the second folding operation and the linear movement accomplishes both the loading operation and the packing operation. This double-function means is a combined apparatus which is attached to right vertical supports 22 and/or right horizontal support 24. Specifically, a rocker arm assembly 50, comprising a rocker arm 51, a rocker arm pivot 53, and a right flipper link 55, is pivotally attached to the upper end of cylinder rod 28 so that the right portion of rocker arm 41 is pulled in movement 57 as rod 28 is retracted. Correspondingly, the left portion of rocker arm 51 pivots in direction 59 as rod 28 retracts. This pivoting movement of arm 51 causes right flipper link 55 to move leftwardly and upwardly, as seen in FIG. 5, to position 55'.

Right flipper assembly 60 comprises a right flipper having flipper shaft 62 and tines 61 which are perpendicularly attached to flipper shaft 62, and a right flipper arm 66, having a link stop channel 68 therewithin, which is pivotally attached to the lower end of link 55.

A pair of carriers 70 each comprise a bushing within cylinders 71 for a guide rod 25, a carrier support plate 73 which is rigidly attached to cylinder 71, a carrier support arm 77 which is extended downwardly from the inner end of plate 73 and is rigidly attached thereto, and a carrier tie bar 75 which is rigidly attached to the top edges of plates 73 and maintains them in parallel and rigidly aligned relationship. Carrier assembly 70 further comprises a rocker arm attachment bracket 79 which is rigidly attached to the lower side of carrier tie bar 75 and midway between cylinders 71, as seen best in FIG. 2. Rocker arm pivot 63, supporting rocker arm 51, passes through bracket 79.

Figure 1:
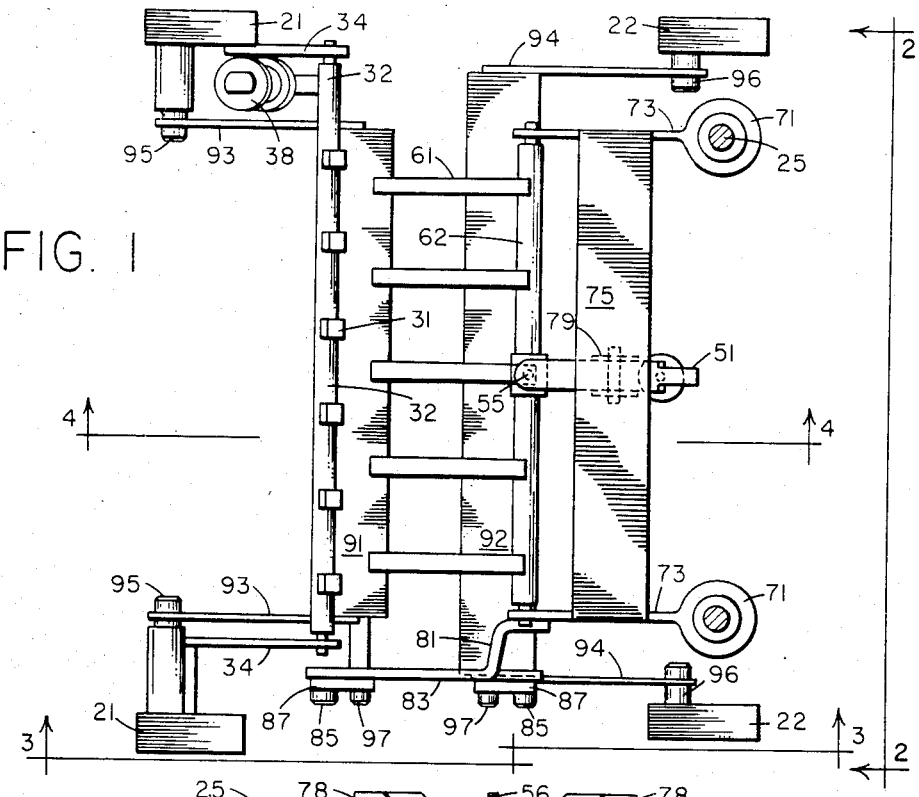
FIG. 1 is a plan view of a folder-loader assembly of the invention, with a right flipper in fold position.
Figure 15:
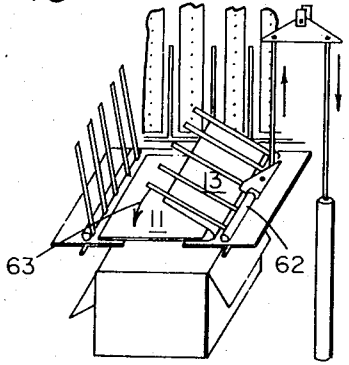
FIG. 15 is a perspective view, similar to FIGS. 12–14, which shows the right end portion being folded onto the left end portion by the right flipper, after the left flipper has returned to its original position.

As best seen in FIG. 5, when cylinder rod 28 is retracted, bringing the right end of rocker arm 51 downward in movement 57 and the left end in reverse corresponding movement 59, so that link 55 moves to position 55', right flipper arm 66 pivots to position 66' and prongs 61 pivot in direction 63 to position 61', as seen in FIG. 1 and in phantom in FIG. 5, thereby laying end portion 13 onto end portion 11, as seen in FIGS. 5, 12 and 15.

The sheet-folding assembly has completed its operations at this point in time, except for returning tines 61 to upright position. However, tines 61 and right flipper shaft 62 must first take part in loading and packing each folded bag 14 before returning to upright position, as parts of a folded-sheet loading and packing assembly which additionally comprises a tray actuator bracket assembly 80 and a pair of stacking tray assemblies.

Figure 3:
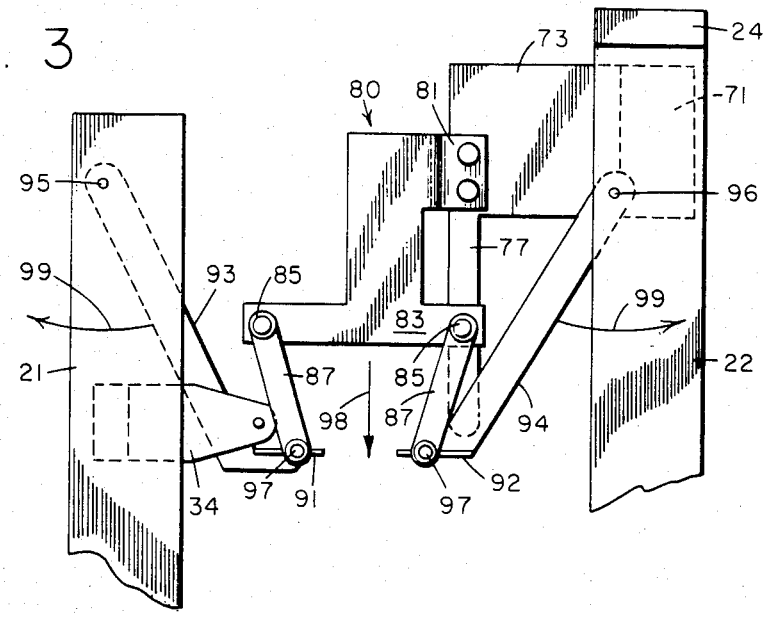
FIG. 3 is a front elevation view of the folder-loader assembly, looking in the direction of the arrows 3—3 in FIG. 1.

Tray actuator bracket assembly 80 comprises a bracket connection 81, a T-member 83, a pair of pivots 85 and a pair of tray links 87, as shown in FIGS. 1 and 3. A pair of stacking tray assemblies comprises left stacking tray 91, right stacking tray 92, a pair of left stacking tray arms 93, a pair of right stacking tray arms 94, left stacking tray arm upper pins 95, right stacking tray arm upper pins 96 and lower stacking tray pins 97. Bracket connection 81 attaches tray actuator bracket assembly 80 to front carrier support plate 73. The pair of pins 85 attach the pair of tray links 87 to T-member 83, and the pair of pins 97 attach links 87 to trays 91,92 to which tray arms 93,94 are rigidly attached. Pins 95,96 respectively attach arms 93,94 to vertical supports 21,22 at both front and back of the frame.

Figure 11:
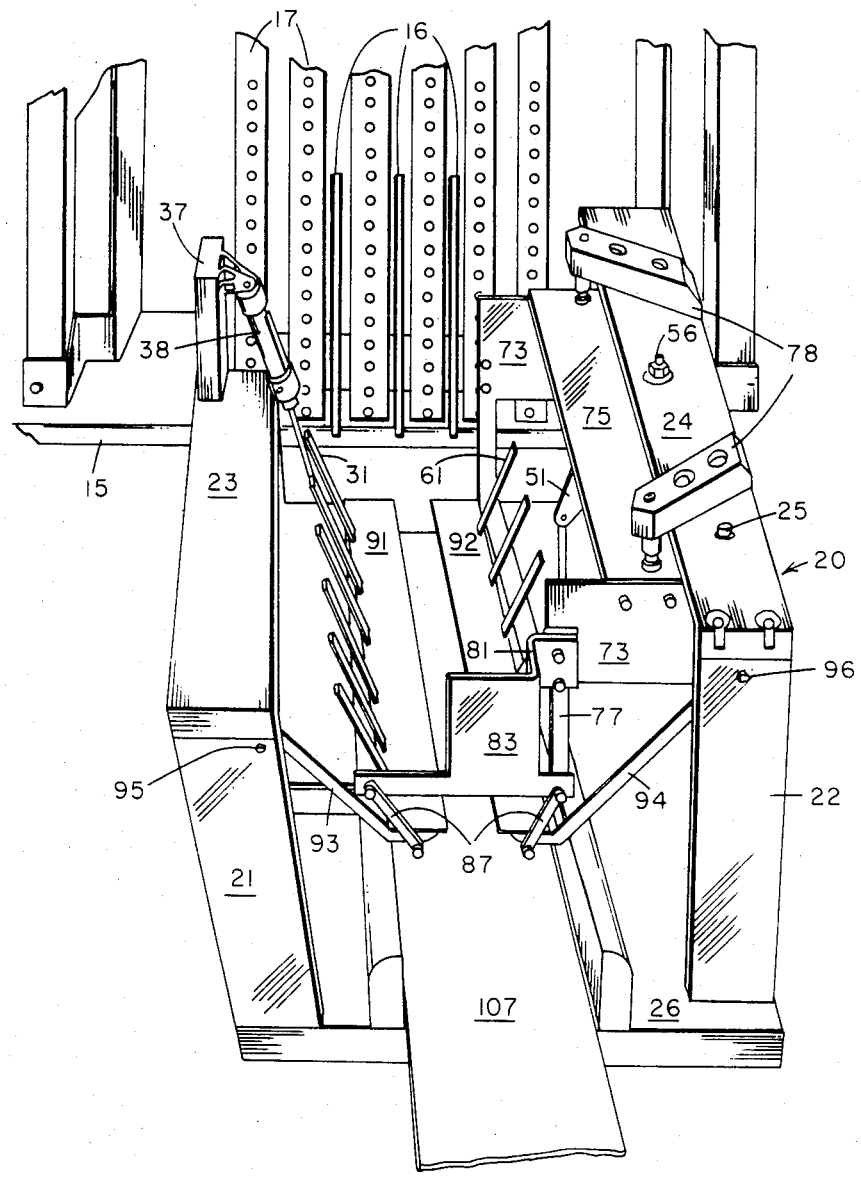
FIG. 11 is a complete front perspective view of the folder-loader assembly and a portion of a machine for making sandwich bags, including vertically disposed conveyor belts and a pivotable swatter for lifting the middle portion of a sandwich bag from the adjacent conveyor.
Figure 16:
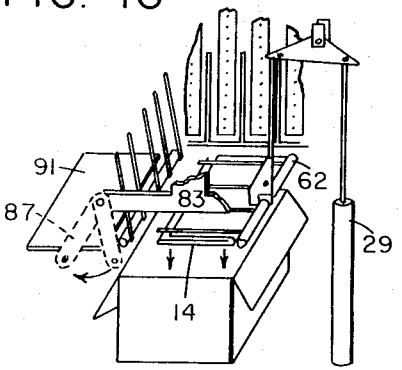
FIG. 16 is a perspective view, similar to FIGS. 12–15, which shows the trays moving sidewardly while the right flipper is propelling the folded bag downwardly into the box.

The folded-sheet loading assembly thereupon begins to operate by sidewardly revolving trays 91,92 in directions 99 and pushing each folded bag 14 toward bottom 101 of box 100 by propelling shaft 62 and tines 61 of the right flipper in direction 98, as shown in FIGS. 5 and 16, until the folded bags 14 are squeezed against bottom 101 with a force controlled by a packing force which equals the force of cylinder 29 less the force of springs 27 plus the weight of rocker arm assembly 50, right flipper assembly 60, carrier assembly 70, tray actuator bracket assembly 80, right stacking tray 92, right stacking tray arms 94 and right stacking tray pins 95,96,97. The sheet-folding assembly then upwardly raises shaft 62 and tines 61 and finally pivots tines 61 to upright position, to be ready for delivery of the next bag 10, as seen in FIG. 11.

This combination of folding, loading and stacking operations is achieved by providing in springs 27 the correct amount of force to support at least the combined weights of the right flipper assembly, the carrier arm assembly and the rocker arm assembly and additionally to resist the force required for cylinder 29 to pull rocker arm 51 in a clockwise pivotal movement, as seen in FIG. 5, until tines 61 have completed the second folding operation. As further downward movement of rod 28 occurs, cylinder 29 overcomes the force of springs 27 and moves carrier assembly 70 and tray actuator bracket assembly 80 downwardly as a unit until the right flipper propels folded bag 14 onto bottom 101 or onto previously stacked bags 14 with a selected packing force.

Coil springs 27, as the biasing means, are suitably five springs surrounding each guide rod 25. Each spring is suitably 2¼ inches high when uncompressed and 0.46 inch high when fully compressed. The loading is 3.68 pounds per inch of compression. The springs are preloaded by fitting five springs into a total height of 7 inches for rods 25. The total travel distance when packing sandwich bags is four inches, which is divided among the five springs on each rod 25. Suitable springs are LC-038G11, sold by the Lee Spring Co.

After the completion of these loading and stacking operations, cylinder 29 extends rod 28, thereby relieving the pressure on springs 27 and allowing the entire unitary combination of right flipper assembly 60, carrier assembly 70 and tray actuator bracket assembly 80 to rise to the level of the folding station, as seen in FIG. 5, as trays 91,92 simultaneously return to restore the platform of the U-shaped channel. Thereafter, as rod 28 continues to move upwardly, the right end of rocker arm 51 pivots counterclockwise and right flipper arm 66 pivots clockwise, as seen from the front of the folder-loader, so that tines 61 also pivot clockwise to come back to approximately upright position, thereby restoring the U-shaped channel of the folder-loader.

The apparatus of this invention is simplified because left flipper assembly 40 is actuated by air cylinder 38, swatter shaft 15 is actuated by a separate cylinder (not shown in FIGS. 1–17), and all the rest of the motion is accomplished by cylinder 29 acting through a linkage. The right flipper pivots on shaft 62 at the bottom ends of vertical arms 77 of the carrier assembly 70 because carrier cylinders 71 are supported by springs 27 on guide rods 25. When cylinder rod 28 pulls on rocker arm 51, it is trying to pull down the main supports of carrier assembly 70 and tray actuator bracket assembly 80, because rocker arm 51 is pivoted on carrier tie bar 75, but the spring force of springs 27 is sufficiently great that it is easier for rocker arm 51 to pivot. This downward force then pulls flipper link 55 upwardly, which in turn pivots flipper 66, causing the right flipper to rotate counterclockwise in direction 63. It is stopped in a horizontal position when right flipper link 55 strikes link stop channel 68.

Then, as cylinder 29 continues to pull downwardly, it overcomes the force of springs 27 and moves carrier assembly 70 and bracket assembly 80 downwardly, causing arms 93,94 to pivot and trays 91,92 to revolve downwardly and outwardly to the sides, so that relative to folded bag 14, trays 91,92 simply move sidewardly out of the way as the right flipper and bag 14 are propelled in direction 98 toward bottom 101 of carton 100. There is sufficient travel distance available in direction 98 for each folded bag 14 to be pressed against bottom 101 or against previously stacked bags 14, with the full packing force to effectuate stacking of the bags into carton 100.

Because link stop channel 68 remains in contact with right flipper link 55 after the downward movement begins and until the right flipper returns to the folding station, the right flipper is held in its horizontal position during its up-and-down vertical travel. Stops 78 on support 24 are adjusted for accurately positioning tines 61 in standby or article-receiving position, slightly outwardly of vertical, after completion of the return movement of cylinder rod 28.

As seen in FIGS. 1–17, the folding station comprises trays 91,92 and left and right flipper tines 31,61. The folding means comprises left and right flipper assemblies 30,60, left flipper arm assembly 40 and rocker arm assembly 50.

The propulsion means comprises loading cylinder 29 and loading cylinder rod 28. The fixed part of the support and guide means comprises vertical supports 21,22 horizontal supports 23, 24, guide rods 5 and base 26. The movable part of the support and guide means comprises carrier assembly 70 and tray actuator bracket assembly 80. Carrier assembly 70, bracket assembly 80, rocker arm assembly 50 and right flipper assembly 60 (while the right flipper is horizontal) can be collectively described, on a functional basis, as a "stomper" apparatus. The guides utilized by the movable part are guide rods 25 which are acted upon by the bushings within carrier cylinders 71.

Figure 18:
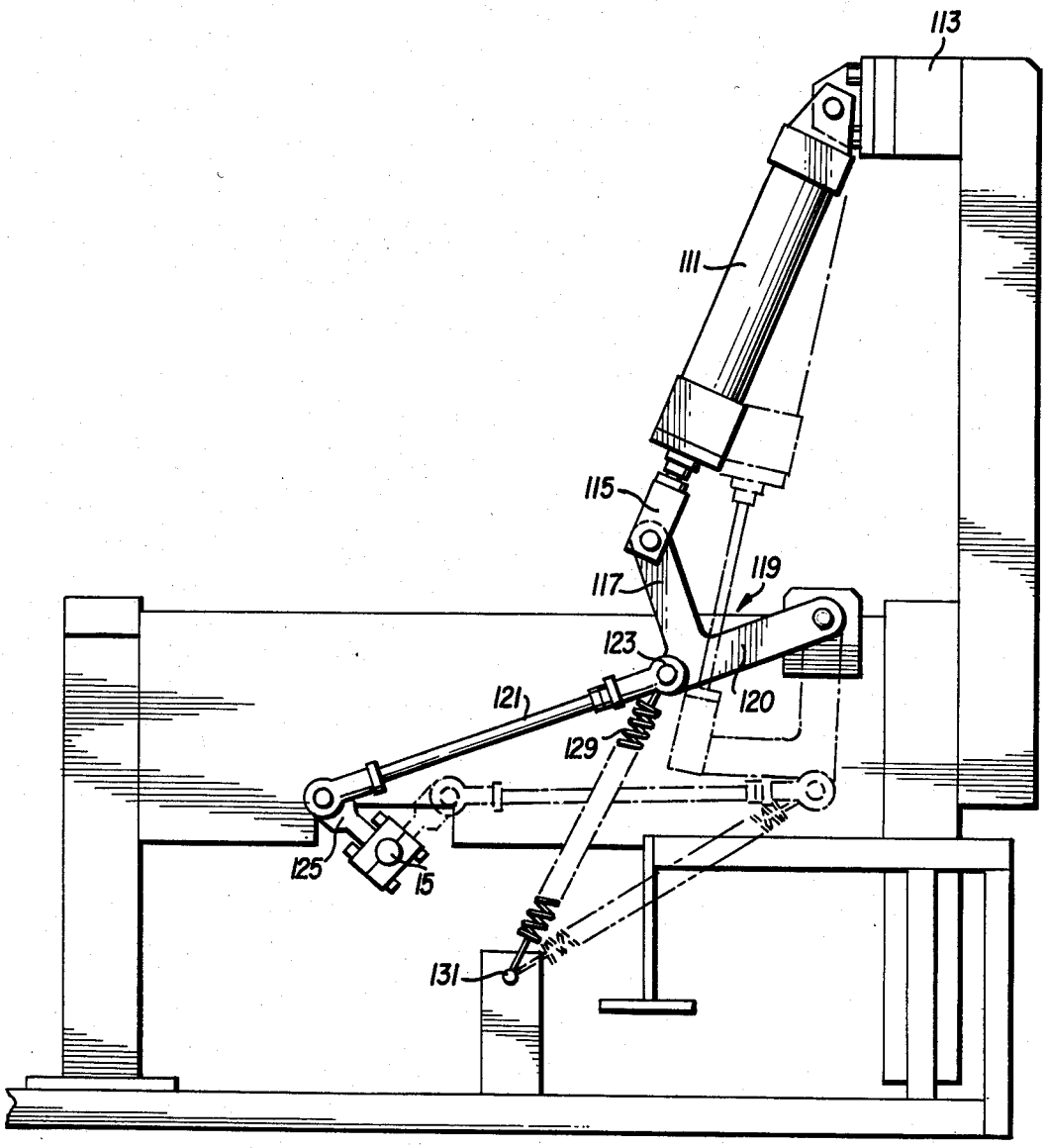

As noted earlier, a separate cylinder is provided for reciprocally actuating swatter shaft 15. This cylinder can be connected to an arm fixed to the swatter shaft and a stop may be provided at each end of the swatter arcuate movement to ensure its proper beginning and terminating positioning. However, when the swatter is abruptly stopped at the end of its travel by cessation of a constant velocity cylinder operation and/or by the hitting of a stop, it undergoes a large, sudden deceleration, which may contribute to wrinkling of bag 10. Slowing down the rate of operation of the swatter driving cylinder to overcome this problem slows down the entire bag folding and loading process. To minimize bag wrinkling problems, while achieving a high average velocity, the swatter linkage mechanism shown in FIG. 18 has been devised. This linkage mechanism, which couples the swatter driving cylinder with the swatter shaft 15, achieves a high average velocity of swatter movement coupled with a gradual deceleration of the swatter to a stop when it reaches a folder-loaded, thereby minimizing bag wrinkling.

The linkage mechanism interconnects the swatter driving cylinder 111, which is pivotably fixed at one end thereof to an upper portion of a fixed support 113, to the shaft 15 of the swatter. The moving rod 115 of cylinder 111 is connected to one arm member 117 of an L-shaped crank arm 119, another arm member 120 of which is pivotably fixed to a lower portion of support 113. An additional straight linkage member 121 is pivotably connected at its one end to a portion 123 of L-shaped crank arm 119 located near the intersection of the two arm members 117,120. Linkage member 121 is pivotably connected at its other end to one end of a swatter arm 125, which in turn is fixedly connected at its other end to shaft 15 of the swatter. When the swatter is at the termination of its movement towards the folder-loader, the position of the swatter cylinder and linkage mechanism is as shown by the solid lines in FIG. 18, while the position of the swatter cylinder and linkage mechanism, when the swatter is at the termination of its movement at the conveyor side, is shown by the dotted lines in FIG. 18.

When the swatter is to be rotated to convey a bag to the folder-loader, piston rod 115 is retracted at a substantially constant velocity, but the linkage mechanism formed by crank arm 119 and linkage member 121 is arranged so that a relatively large displacement of swatter arm 125 initially occurs upon rod 115 displacement, but the amount of swatter arm displacement (and thus its velocity) is gradually reduced, as the swatter approaches the terminus of its movement toward the folder-loader. At the end of this movement arm 121 is linearly aligned with arm member 120 of the crank arm 119, which defines the end of the swatter movement, i.e., the position where it stops. The gradual deceleration of the swatter arm 125 as the swatter approaches the termination of its forward movement occurs because of the changing angular relationship between the arm member 120 of crank arm 119 and linkage member 121, which causes a gradual deceleration of the displacement of the swatter arm in the direction of its forward movement until straight arm 121 and arm member 120 are linearly aligned, as shown in solid lines in FIG. 18. The linkage mechanism positively stops the swatter arm 125 at the end of the movement of the swatter toward the folder-loader without requiring mechanical stops and minimizes over-travel due to inertia and consequent possible wrinkling of bag 10.

The cylinder 111 displacement is large enough so that the inertia of the linkage mechanism and swatter parts represent a small portion of the cylinder's force capability.

As a modification to the linkage mechanism, a spring 129 can be attached at one end to the pivotal connection of arms 120 and 121 and at its other end to a fixed support 131 located approximately along the bisector of the path of movement of the pivotal connection of arms 120 and 121. Spring 129 applies an increasing tensioning force on arm member 120 as it approaches the terminating ends of its reciprocal movement, which opposes the force being applied by cylinder 111 thereto, thereby assisting in the deceleration of the swatter. The tension applied by spring 129 operates as an additive force to that of cylinder 111 when cylinder 111 begins to move arm member 120 from either of the two positions illustrated in FIG. 18, which helps overcome the inertia of the linkage mechanism and produces a quick acceleration of the swatter. In effect, spring 129 tends to bias arm member 120, and thus the swatter arm 125 and swatter to intermediate positions in their respective paths of reciprocal travel.

Other crank arm 119 arrangements can be employed. For example, piston rod 115 could be connected to one distal end of an arm member of an L-shaped crank arm, while the distal end of the other arm member is connected to linkage member 121, the crank arm being pivoted to a fixed point at a portion near the intersection of the arm members. It is also possible to use a linear crank arm, essentially consisting of arm member 120 with piston rod 115 being pivotably coupled thereto at a point between the fixed pivotal connection of the crank arm 119 shown in FIG. 18 and the pivotal connection of crank arm 119 and linkage member 121.

Although preferred embodiments of the invention have been shown and described, it should be appreciated that many modifications may be made thereto without departing from the spirit and scope of the invention. Accordingly, the invention is not limited by the foregoing description, but is only limited by the scope of the claims appended hereto.

I claim:

1. A swatter assembly comprising:

a pivotable swatter for moving thin sheet-like articles from a first location to a second location and comprising a rotatable shaft and at least one element projecting from said shaft for contacting and moving said article;

means adjacent said first location for conveying a said article to a position where it is contacted by and moved by said projecting element;

means adjacent said second location for receiving a said article moved by said swatter; and, means for reciprocally rotating said shaft and comprising;

a driving cylinder including a driving rod;

a swatter arm fixedly connected to said shaft; and means responsive to a constant velocity movement of said driving rod for moving said swatter arm to forwardly move said swatter toward said receiving means with a movement force which causes said swatter to gradually decelerate to a stop as it approaches said second location.

2. A swatter assembly as in claim 1, wherein said means for moving said swatter arm comprises an arm member connected to said driving cylinder and a linkage member connected between said arm member and swatter arm, said linkage member forming an angle to a portion of said arm member to which it is connected at the beginning of forward movement of said swatter and being linearly aligned with said arm member at the termination of forward movement of said swatter.

3. A swatter assembly as in claim 2, wherein said arm member is provided as part of a crank arm which has an L-like shape having intersecting arm members, said driving rod is pivotably connected near a distal end of one of the intersecting arm members, a distal end of the other one of the intersecting arm members is pivotably connected to one of said linkage member and a fixed point, and a portion of said crank arm adjacent the intersection of the two arm members is connected to the other of said linkage member and fixed pivot.

4. A swatter assembly as in claim 1, further comprising means for providing a biasing force which biases said swatter arm to an intermediate position in its path of travel, said biasing force acting with the force applied by said cylinder to increase a rate of acceleration of said swatter at least at the beginning of its forward movement and acting against the force applied by said cylinder to increase the rate of deceleration of the swatter at least at the end of its forward movement.

5. A method for sequentially folding and loading a plurality of thin, limp, sheet-type articles into a receptacle, comprising the following steps:

A. sequentially delivering each article of said plurality of articles to a folding station having a movable platform and a folding member in standby position, said article being gradually decelerated to a stop as it approaches said folding station;

B. folding said article at least once with said folding member, whereby the folded article is transversely spaced from and aligned with the bottom of a receptacle therefor while supported by said platform;

C. removing said platform from said folded article and simultaneously pushing said folded article toward said bottom by propelling said folding member;

D. loading said folded article within said receptacle;

E. returning said folding member to said folding station and to said standby position; and F. returning said platform to said folding station.

6. The method of claim 5, wherein said article is packed toward said bottom with a selected force upon said folding member.

7. The method of claim 5, wherein said folding member of step A is a second folding member and said article is folded by a first folding member before said folding of step B.

8. The method of claim 5, wherein said platform is in two parts which are sidewardly removed in opposite directions.

9. The method of claim 5, wherein said article is delivered to said folding station in partially folded condition.

10. A method for sequentially folding and loading a plurality of thin, limp, sheet-type articles into a receptacle having a bottom, comprising the following steps:

A. partially folding each article of said plurality of articles along two parallel fold lines, whereby said article is divided into a first end portion, a middle portion having two side edges and fold lines as two end edges, and a second end portion;

B. conveying said partially folded article to and depositing it on supports of a folding station which is disposed in parallel to said bottom of said receptacle, said partially folded article being gradually decelerated to a stop as it approaches said folding station;

C. completely folding said first end portion onto said middle portion;

D. completely folding said second end portion onto said first end portion to form a folded article which is spaced from, parallel to, and aligned with said bottom of said receptacle; and E. removing said supports and transversely propelling said folded article toward said bottom and into said receptacle.

11. The method of claim 10, wherein said folded article which is propelled into said receptacle in step E is additionally pushed into sequentially close proximity with said bottom.

12. The method of claim 10, wherein said receptacle comprises four sides and said supports comprise at least one tray which moves sidewardly beyond at least one side of said four sides in step E.

13. The method of claim 12, wherein said depositing of step B is performed in a pivotal movement in which said side edges of said middle portion revolve in parallel to the axis of said movement.

14. The method of claim 13, wherein said article is resting on a conveyor when said pivotal movement begins.

15. The method of claim 14, wherein said pivotal movement begins by picking up said middle portion from said conveyor while supporting said middle portion along at least said two fold lines, whereby said first and second end portions trail behind said middle portion during said pivotal movement to accomplish said partial folding.

16. The method of claim 15, wherein said first and second end portions are disposed in approximately perpendicular relationship to said middle portion when said depositing occurs.

17. The method of claim 16, wherein said pivotal movement occurs through an arc of approximately 180°.

18. The method of claim 17, wherein said conveyor is disposed in approximately parallel relationship to said supports.

19. The method of claim 16, wherein said pivotal movement occurs through an arc of approximately 90°.

20. The method of claim 19, wherein said conveyor is disposed in appoximately perpendicular relationship to said supports.

21. The method of claim 20, wherein said bag is held approximately parallel to said conveyor by vacuum until said pivotal movement begins to occur.

22. The method of claim 20, wherein said second end portion is held in said perpendicular relationship to said middle portion by vacuum until said folding of step D begins to occur.

23. The method of claim 22, wherein said first end portion is additionally held in said perpendicular relationship by vacuum until said folding of step C begins to occur.

24. An apparatus for sequentially delivering, folding and loading a plurality of thin, limp, sheet-type articles into a receptacle having a bottom, after said articles have been sequentially conveyed to a pick-up station, and for packing said loaded articles within said receptacle, comprising:

A. a delivery assembly for sequentially delivering said articles to a folding station, comprising:

1. a pivotable swatter, having at least one member which is perpendicularly disposed to the axis of rotation of said swatter, which is disposed and actuated so that said member is pivotally beyond each said article when said article arrives at said pick-up station, whereby said article is lengthwise divided by said member of said swatter into three parts, and 2. a first actuator means for revolving said swatter through an arc, whereby said article is delivered to said folding station with a middle portion supported by said swatter and with first and second end portions partially folded beyond said member of said swatter, said first actuator means gradually decelerating said swatter to a stop as it approaches the end of its movement toward said folding station;

B. a folding assembly for sequentially folding said articles, comprising:

1. a pair of revolvable trays which are disposed in side-by-side relationship to form a platform which is aligned with, parallel to, but spaced from said bottom and is adapted to receive at least said middle portion, 2. a pair of pivotable flippers which are disposed approximately perpendicularly to said platform when in article-receiving position and are spaced apart by about the length of one said part to form said folding station, in combination with said trays, as a U-shaped channel, 3. a second actuator means for pivoting one said flipper through about 90° to lay said first end portion onto said middle portion and for returning said one flipper to said article-receiving position, 4. a third actuator means for pivoting the other said flipper through about 90° to lay said second end portion onto said first end portion, whereby said article is fully folded, and for returning said other flipper to said article-receiving position after said loading and said packing are completed; and C. a loading assembly for loading said fully folded articles into said receptacle and for packing said articles against said bottom with a selected force, comprising:

1. a tray-removing means for sidewardly moving said pair of trays beyond said folding station, 2. a propulsion means for transversely moving said other flipper and said fully folded article toward said bottom to effectuate said loading and for returning said other flipper to said folding station after said packing, and 3. a packing means for exerting said selected force upon said fully folded article and against said bottom to accomplish said packing before said returning.

25. The apparatus of claim 24, whereby said third actuator means, said tray-removing means, said propulsion means, and said packing means comprise a single cylinder and its cylinder rod which is connected to said other flipper.

26. The apparatus of claim 25, wherein a biasing means separates said other flipper from said sidewardly moving pair of trays, said other flipper, and said packing means.

27. The apparatus of claim 26, wherein said other flipper is pivotally connected to a rigid carrier member which is connected to said cylinder rod.

28. The apparatus of claim 24, wherein said biasing means comprises a spring which supports said other flipper and said carrier member until said pivoting the flipper is completed and thereafter permits said transversely moving to occur.

29. The apparatus of claim 28, wherein said pair of trays is pivotally connected to said carrier member, whereby said transversely moving effectuates said sidewardly moving of said pair of trays.

30. An apparatus for sequentially delivering and folding a plurality of plastic bags along a pair of parallel fold lines, after said bags have been conveyed to a pick-up station, and for loading and packing the folded bags within a carton therefor, comprising:

A. a rigid frame which comprises a pair of spaced-apart guide rods and a base;

B. a swatter assembly, comprising:

1. a pivotable delivery swatter which comprises:
   a. a shaft which is rotatable about its axis,
   b. a pair of parallel prongs which are attached at one end to said shaft and are perpendicularly disposed thereto, said prongs being spaced apart by the distance between said pair of parallel fold lines,
   c. a plurality of support tines which are attached at one end to each said prong and are perpendicularly disposed thereto, whereby all said support tines are in parallel and trailingly revolve within two spaced-apart planes of revolution which are defined by said parallel prongs when said shaft rotates for said delivering, and
   d. a first movement means for rotating said shaft from said pick-up station to a folding station and for rotatively returning to said pick-up station, said first movement means gradually decelerating said swatter to a stop as it approaches said folding station;

C. a folding assembly, comprising:

1. a left flipper assembly which comprises:
   a. a left flipper having a shaft, which is rotatably attached to said frame, and a plurality of left flipper tines which are perpendicularly attached at one end to said shaft, and
   b. a left flipper cylinder which is attached to said frame and has a cylinder rod which is attached to said left flipper shaft for revolving said left flipper from article-receiving position to folding position,
2. a right flipper assembly which comprises:
   a. a right flipper having a shaft, which is rotatably attached at ends thereof to a pair of carrier arms, and a plurality of right flipper tines which are perpendicularly attached at one end to said right flipper shaft, said left flipper tines and said right flipper tines being sideways beyond said planes of revolution when in article-receiving position, and
   b. a flipper arm which is rigidly attached to said right flipper shaft;
3. a rigid carrier assembly which is slidably attached to said pair of guide rods and comprises said pair of carrier arms, and
4. a rocker arm assembly which is pivotally attached to said carrier assembly and to said flipper arm;

D. a stacking tray assembly, comprising a pair of stacking trays, each stacking tray having a pair of arms which are pivotally attached at one end to said frame;

E. a tray actuator bracket assembly, comprising a T-member, which is rigidly attached to said carrier assembly, and two pairs of tray links, each pair of tray links being pivotally attached to said bracket assembly and to the ends of one said tray;

F. a linear movement means, for pivoting said right flipper and for performing said loading and said packing, which is connected to said rocker arm assembly; and G. a biasing means which supports at least the combined weights of said right flipper assembly, said carrier assembly and said rocker arm assembly and which additionally resists the force required for pivoting said right flipper, whereby said linear movement means becomes a dual-function means.

31. The apparatus of claim 30, wherein said carrier assembly comprises a pair of carrier cylinders containing bushings which slidably surround said pair of guide rods, a pair of carrier support plates which are rigidly attached to said carrier cylinders, a carrier tie bar which is rigidly attached to said carrier support plates and a rocker arm attachment bracket which is attached to said tie bar.

32. The apparatus of claim 31, wherein said rocker arm assembly comprises a rocker arm which is pivotally attached between its ends to said rocker arm attachment bracket.

33. The apparatus of claim 32, wherein said linear movement means comprises a fluid-actuated cylinder and its cylinder rod which is pivotally connected to one of said ends of said rocker arm, said cylinder being attached to said base.

34. The apparatus of claim 33, wherein said flipper arm is connected with a link member to the other said end of said rocker arm and contains a stop surface for said link member which stops said revolving of said right flipper when said right flipper tines are horizontally disposed during said loading and said packing.

* * * * *